US009045928B1

(12) United States Patent
Seitz et al.

(10) Patent No.: US 9,045,928 B1
(45) Date of Patent: Jun. 2, 2015

(54) METHOD AND APPARATUS TO RAISE AND LOWER AN OVERHEAD DOOR

(71) Applicant: Floating Door, LLC, Ketchum, OK (US)

(72) Inventors: Pete Seitz, Ketchum, OK (US); Jerry Hopper, Ketchum, OK (US)

(73) Assignee: FLOATING DOOR, LLC, Ketchum, OK (US)

( * ) Notice: Subject to any disclaimer, the term of this patent is extended or adjusted under 35 U.S.C. 154(b) by 0 days.

(21) Appl. No.: 14/271,632

(22) Filed: May 7, 2014

Related U.S. Application Data

(63) Continuation-in-part of application No. 14/066,003, filed on Oct. 29, 2013, now Pat. No. 8,863,438.

(51) Int. Cl.

| | |
|---|---|
| ***E05F 11/00*** | (2006.01) |
| ***E06B 3/00*** | (2006.01) |
| ***E05F 15/16*** | (2006.01) |
| ***E05F 15/08*** | (2006.01) |

(52) U.S. Cl.
CPC ..... *E05F 15/1661* (2013.01); *E05F 15/083* (2013.01)

(58) Field of Classification Search
CPC ..... E05F 15/083; E05F 15/1661
USPC ..... 49/197, 199, 506; 160/188, 189, 190, 160/193
See application file for complete search history.

(56) References Cited

U.S. PATENT DOCUMENTS

| | | | | | |
|---|---|---|---|---|---|
| 3,878,879 | A * | 4/1975 | Manns | 160/273.1 |
| 4,872,632 | A | 10/1989 | Johnson | |
| 5,159,967 | A * | 11/1992 | Ashley et al. | 160/265 |
| 5,365,636 | A * | 11/1994 | Jensen | 16/67 |
| 5,632,317 | A * | 5/1997 | Krupke et al. | 160/265 |
| 5,839,230 | A * | 11/1998 | Licking et al. | 49/360 |
| 6,019,156 | A * | 2/2000 | Wagner et al. | 160/310 |
| 6,092,347 | A | 7/2000 | Hou | |
| 7,252,133 | B2 * | 8/2007 | Bengtsson et al. | 160/265 |
| 8,025,090 | B2 * | 9/2011 | Kicher | 160/191 |
| 8,327,583 | B2 | 12/2012 | Reimer et al. | |
| 2005/0082015 | A1 * | 4/2005 | Altimore | 160/133 |
| 2010/0077664 | A1 | 4/2010 | Stensland | |
| 2011/0308744 | A1 * | 12/2011 | Kicher | 160/191 |

* cited by examiner

*Primary Examiner* — Jerry Redman
(74) *Attorney, Agent, or Firm* — Head, Johnson & Kachigian, P.C.

(57) ABSTRACT

A method and apparatus to raise and lower an overhead door comprising a lift mechanism, a master pulley block, a fixed pulley mounted to the lift mechanism, a plurality of guide sheaves each associated and spaced from with the master pulley block and supported by the elongated support member, and a plurality of cables each having two opposing ends and passing over the fixed pulley and the master pulley block and further passing over an associated one of the plurality of guide sheaves, wherein each cable of the plurality of cables attaches by attachment means to an overhead door.

19 Claims, 11 Drawing Sheets

METHOD AND APPARATUS TO RAISE AND LOWER AN OVERHEAD DOOR

CROSS-REFERENCE

This application is a continuation-in-part of U.S. patent application Ser. No. 14/066,003 filed Oct. 29, 2013, now issued U.S. Pat. No. 8,863,438, which is incorporated herein by reference in its entirety.

BACKGROUND OF THE INVENTION

1. Field of the Invention

The present invention relates generally to large overhead doors and, more particularly, to an apparatus and to a method of raising and lowering an overhead door. In particular, the present invention is directed to an apparatus and method using a power driven pulley assembly to raise and lower an overhead door.

2. Related Art

By way of background, large overhead doors are utilized in a variety of applications, such as in industrial plants and for airplane hangars. The overhead doors are typically fabricated from a metal frame to form a single planar piece which is covered with a metal or other face material. For example, an apparatus and method of construction of an overhead door is disclosed in Applicant's co-pending U.S. patent application Ser. No. 14/066,003 filed Oct. 29, 2013 which is incorporated herein by reference in its entirety.

The overhead doors are very large, and tend to be relatively heavy. Because the overhead doors are fabricated to form one single piece, they cannot bend at hinges like garage doors that are typically used for housing automobiles. Because the overhead doors are large, heavy and cannot bend, lifting or raising the overhead door proves to be difficult.

Accordingly, it would be desirable to develop an apparatus and a method to raise and lower an overhead door that is able to lift the large overhead door as a single piece.

It is further desirable to develop an apparatus and a method to raise and lower an overhead door that could be adapted to raise and lower nearly any size or configuration of overhead door.

It is further desirable to develop an apparatus and a method to raise and lower an overhead door using a hydraulic cylinder.

It is further desirable to develop an apparatus and a method to raise and lower an overhead door using a pulley system.

SUMMARY OF THE INVENTION

The present invention is directed to an apparatus and a method of raising and lowering an overhead door. Generally, the embodiments in accordance with the present disclosure provide a raising and lowering apparatus specifically designed for use with large overhead doors, such as in industrial plants or for airplane hangars, wherein the door is raised and lowered in one solid piece without bending.

In accordance with one example embodiment, the raising and lowering apparatus comprises a lift mechanism, for example, a hydraulic cylinder, for driving a pulley system to raise and lower the overhead door. In one embodiment, the lift mechanism comprises a hydraulic cylinder installed into a building housing the overhead door, wherein the cylinder is positioned to the side of the overhead door in vertical alignment to the ground. A fixed pulley is mounted at the top or end of the lift mechanism. A series of cables extend from the side of the overhead door and up along an elongated support member extending across the top of the overhead door and mounted within the building. Each of the cables is anchored within a master pulley block. The cables pass around a fixed pulley mounted to the lift mechanism, and then pass over a master pulley sheave located within the master pulley block. From there, the cables pass over a plurality of single-grooved guide sheaves. Each individual cable in a plurality of cables is individually associated with an individual single-grooved guide sheave. After an associated individual cable passes over a guide sheave, the individual cable extends tangentially from the guide sheave and downward toward approximately the midpoint of the overhead door. There the individual cable meets with and rests upon a stationary half sheave that is welded onto the overhead door, and inserts into an opening of the overhead door. On the inside of the overhead door the cable attaches to a clamp plate by way of cable clamps.

In operation, the lift mechanism, such as a hydraulic cylinder, is actuated to extend or retract, depending on whether the door is being raised or lowered. If it is desired to raise the door, the lift mechanism is actuated to pull down on a fixed pulley which is mounted to the lift mechanism and is in association with a master pulley block. By retraction of the lift mechanism, the series of cables passing over the fixed pulley are pulled or extended downward in the direction of the ground, thereby tightening and pulling each cable which is individually anchored to the overhead door at respective positions and the force created pulls to lift or raise the overhead door. This arrangement reduces the number of components necessary and allows for the pulleys and lift mechanism to be closely installed to the door opening.

If it is desired to lower the door, the opposite occurs, and the lift mechanism is extended to slowly release slack to a plurality of cables and move the cables and pulleys in the opposite direction, lowering the door.

The overhead door includes two opposed guide rails or tracks, along with two guide rollers on each side of the overhead door. When the lift mechanism pulls the cables over the pulley system, the overhead door is lifted and guided along the guide rails. This arrangement serves to reduce the stress and weight of raising and lowering the overhead door.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
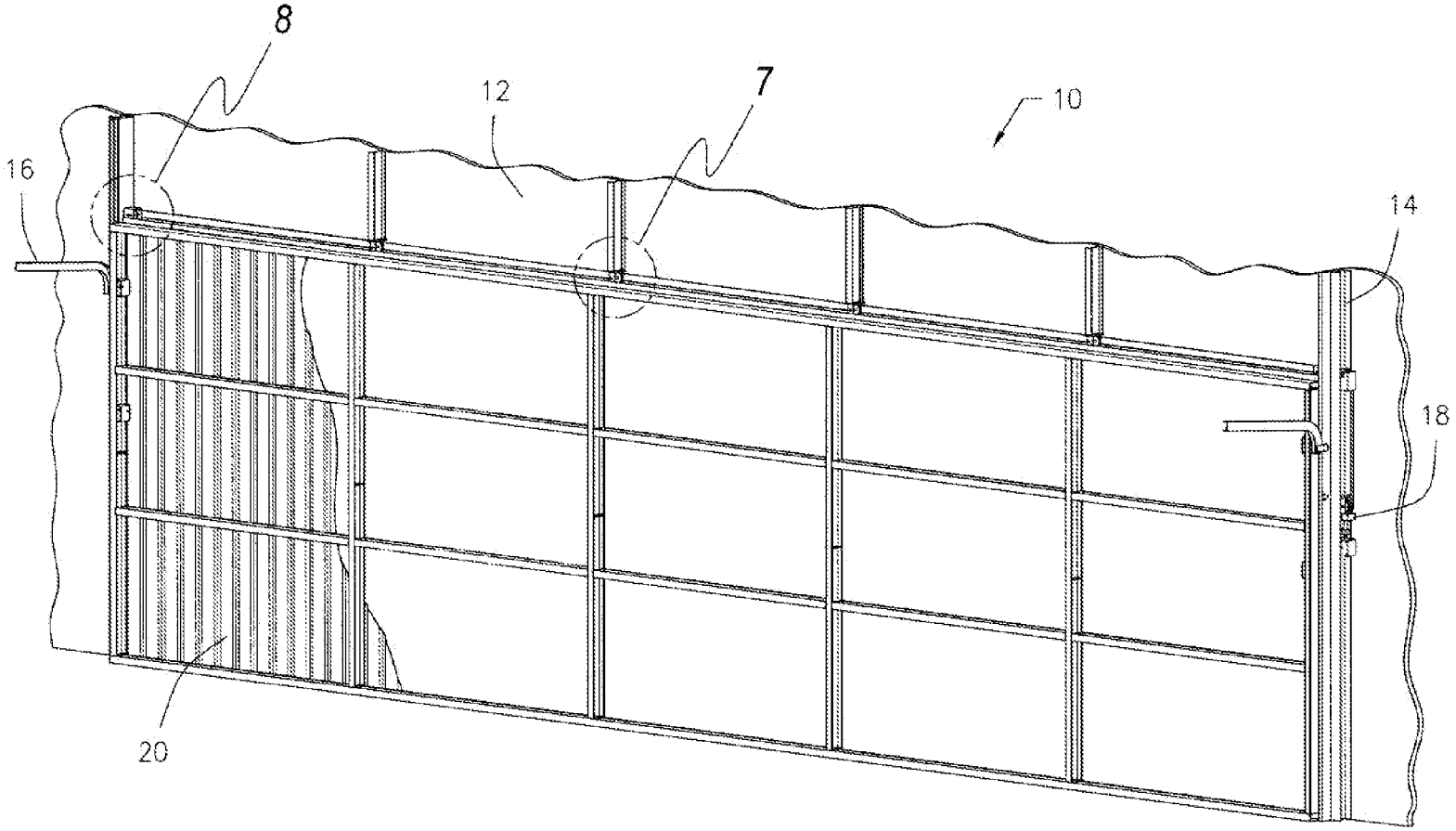
FIG. 1 illustrates a perspective view of an apparatus to raise and lower an overhead door constructed in accordance with the present invention shown installed in an overhead door which is further installed in a building.

Referring to the drawings in detail, FIG. 1 illustrates a perspective view of an overhead door 10 constructed in accordance with the present invention. The apparatus is shown installed in an opening in a building 12 having a plurality of building structural beams 14. The FIG. 1 view is shown from the inside of the building 12.

The overhead door 10 is shown in a closed or lowered position; however, it may be raised or opened utilizing the method and the apparatus described herein, including a lift mechanism 18.

A pair of guide tracks or rails 16 is arranged on opposed sides of the overhead door 10, each having a substantially vertical portion fixed to the building 12. The pair of guide rails 16 curve to form a substantially horizontal portion that extends into the building 12. The length of the horizontal portion is only a short portion of the travel of the door frame.

A pair of guide rollers is mounted on either side of the overhead door and aligns and rolls along the guide rails 16. This arrangement serves to reduce the stress and weight of raising and lowering the overhead door as well as limits the movement of the overhead door.

An outer face 20 of the door 10 has been partially removed for ease of viewing.

A preferred embodiment may further include a stop mechanism micro switch (not shown) placed at a location within each guide rail 16 to provide a mechanism to stop or block the guide rollers from further movement, and halting the door. The micro switch is connected to and controlled by a control box located on the side of the building.

The overhead door 10 may further include a pin-lock at the bottom corners on either side of the overhead door to associate with and be received by the building foundation. In use, when the door is lowered and closed, the pin mechanism aligns with an opening drilled in the building foundation. The pin is received by the opening limiting movement of the closed overhead door in the case of strong weather conditions, such as wind.

Figure 2:
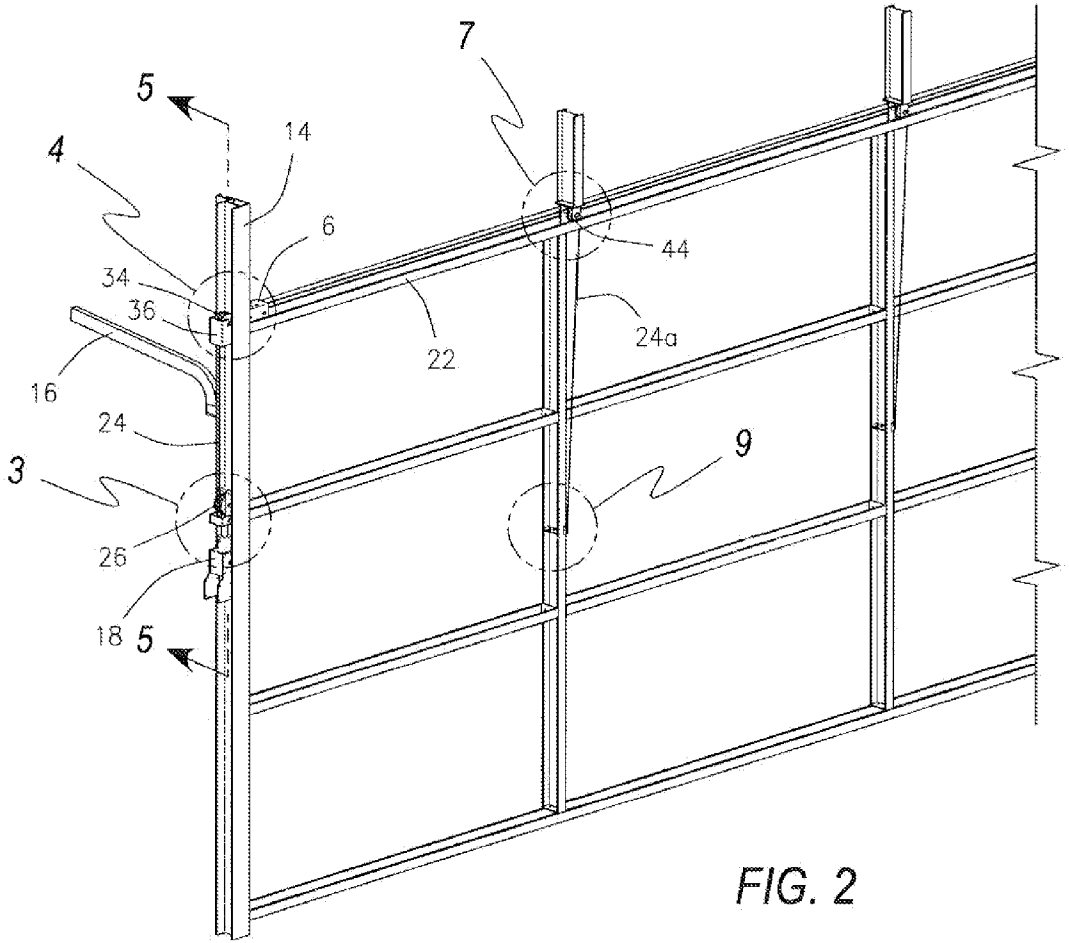
FIG. 2 illustrates a front perspective view of the apparatus to raise and lower an overhead door shown in FIG. 1.

FIG. 2 illustrates a perspective view of a preferred embodiment of the present invention with the face of the door removed for clarity. FIG. 2 illustrates how the cables pass over the pulleys and sheaves to lift the overhead door, while the pulleys and component parts are shown enlarged in later figures. The FIG. 2 view is shown from the outside of the building.

In operation, to raise the overhead door, a lift mechanism 18 is actuated to retract. During retraction of the lift mechanism 18, a fixed pulley 26, attached to the lift mechanism 18, also retracts moving downward. This movement pulls a plurality of cables 24 downward. The plurality of cables 24 have an end 58 which is located and anchored within a master pulley block 36. The plurality of cables 24 extend downward to pass around a fixed pulley 26. The plurality of cables 24 then extend upward where they pass over master sheave 34 which is in association with fixed pulley 26. The plurality of cables 24 extends longitudinally along elongated support member 22 to be received by a guide sheave 38, 44, or 50. Each individual cable of the plurality of cables 24 is associated with an individual single-grooved guide sheave 38, 44, or 50. Thus, the plurality of guide sheaves 38, 44, 50 will equal the number of cables in the plurality of cables 24. At each single-grooved guide sheave 38, 44, 50, one cable 24*a* of the plurality of cables 24 passes over a single-grooved guide sheave 38, 44, 50 and tangentially extends from the single-grooved guide sheave 38, 44, 50 and downward to attach to the overhead door. The remaining cables of the plurality of cables 24 continue to extend further along an elongated support member 22 where each remaining cable is similarly received by a subsequent single-grooved guide sheave 38, 44, 50. Similarly, when the cable is received by the single-grooved guide sheave 38, 44, 50, it tangentially extends from the single-grooved guide sheave 38, 44, 50 and downward to attach to the overhead door at a designated point and so on until all cables have extended downward over a single-grooved guide sheave and attached to the overhead door at designated points.

By providing a plurality of cables 24 anchored at end 58 within a master pulley block 36 then passed around a fixed pulley 26 in association with a master pulley block 36, a mechanical advantage of 2 to 1 is realized. By extending or retracting the lift mechanism 18, the large overhead door can be safely and easily raised or lowered.

Figure 3:
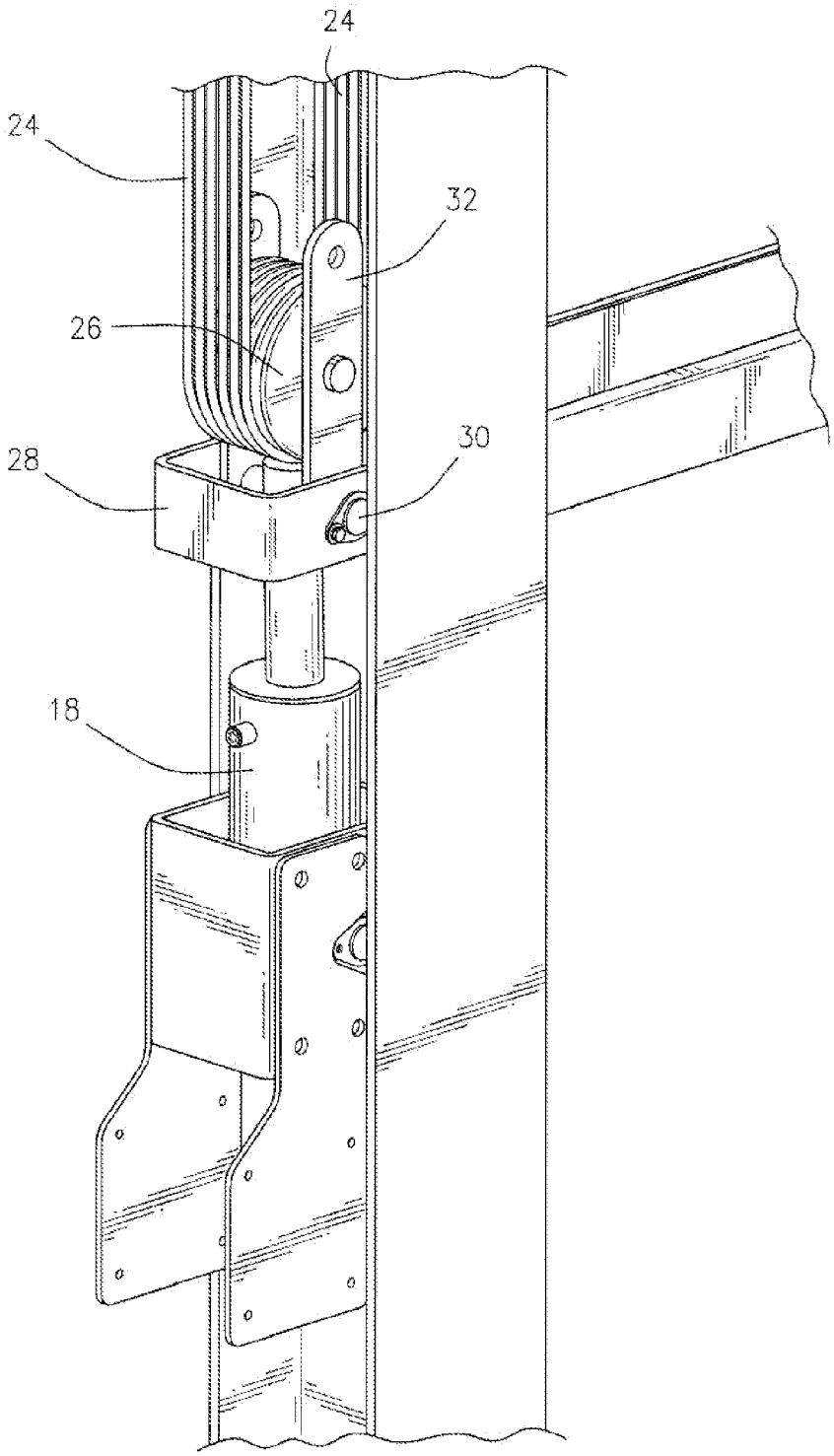
FIG. 3 illustrates a perspective view of a lift mechanism and attached fixed pulley used in accordance with the present invention.

Lift mechanism 18 with attached fixed pulley 26 is shown in FIG. 3. The lift mechanism shown in FIG. 3 is a hydraulic cylinder or ram; however, it may be appreciated that the lift mechanism 18 may take on other types of lifting mechanisms, such as a pneumatic cylinder or a worm gear. The lift mechanism 18 is shown in an extended position. In operation, the lift mechanism 18 either retracts, pulling the fixed pulley 26 downward to raise the door, or the lift mechanism 18 extends to lower the door.

The fixed pulley 26 is fixed by a central axle between a pair of opposing arms 32. The pair of opposing arms 32 creates a means of attachment for the fixed pulley 26 and the lift mechanism 18. Pin 30 mounts the pair of opposing arms 32 and the rod of the lift mechanism 18 together. A brace 28 may also be mounted by pin 30 for additional security. Fixed pulley 26 may comprise a plurality of grooves arranged to receive a plurality of cables 24. In one embodiment, fixed pulley 26 includes six grooves arranged to receive a plurality of six cables, however, it may be appreciated that fixed pulley 26 may comprise more or less grooves, depending on the particular application. The cables 24 each have two ends and are typically made of a durable, braided wire, but could also be made of other non-limiting materials.

Figure 4:
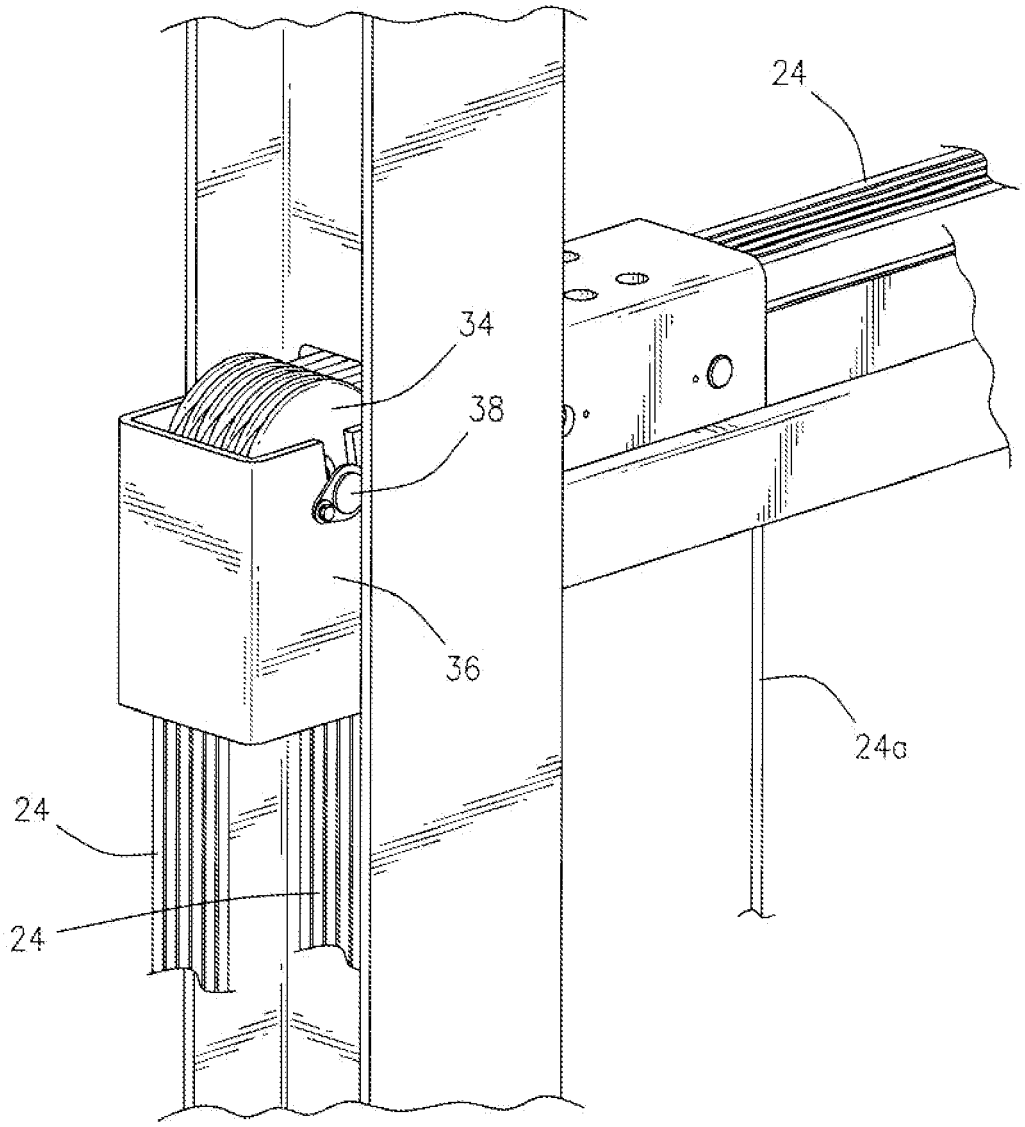
FIG. 4 is a perspective view of a master pulley block and plurality of cables in accordance with the present invention.

The master pulley block 36 is shown in detail in FIG. 4. The master pulley block 36 includes a housing and a master sheave 34 rotatably mounted on a central axle. The master pulley block 36 is mounted into the door frame in association with elongated support member 22. Master sheave 34 may comprise a plurality of grooves arranged to receive a plurality of cables 24. In one embodiment, master sheave 34 includes six grooves arranged to receive a plurality of six cables, however, it may be appreciated that master sheave 34 may comprise more or less grooves depending on the number of cables and the particular application. The plurality of cables 24 extend to a plurality of single-grooved guide sheaves, as can be seen in FIG. 5.

Figure 5:
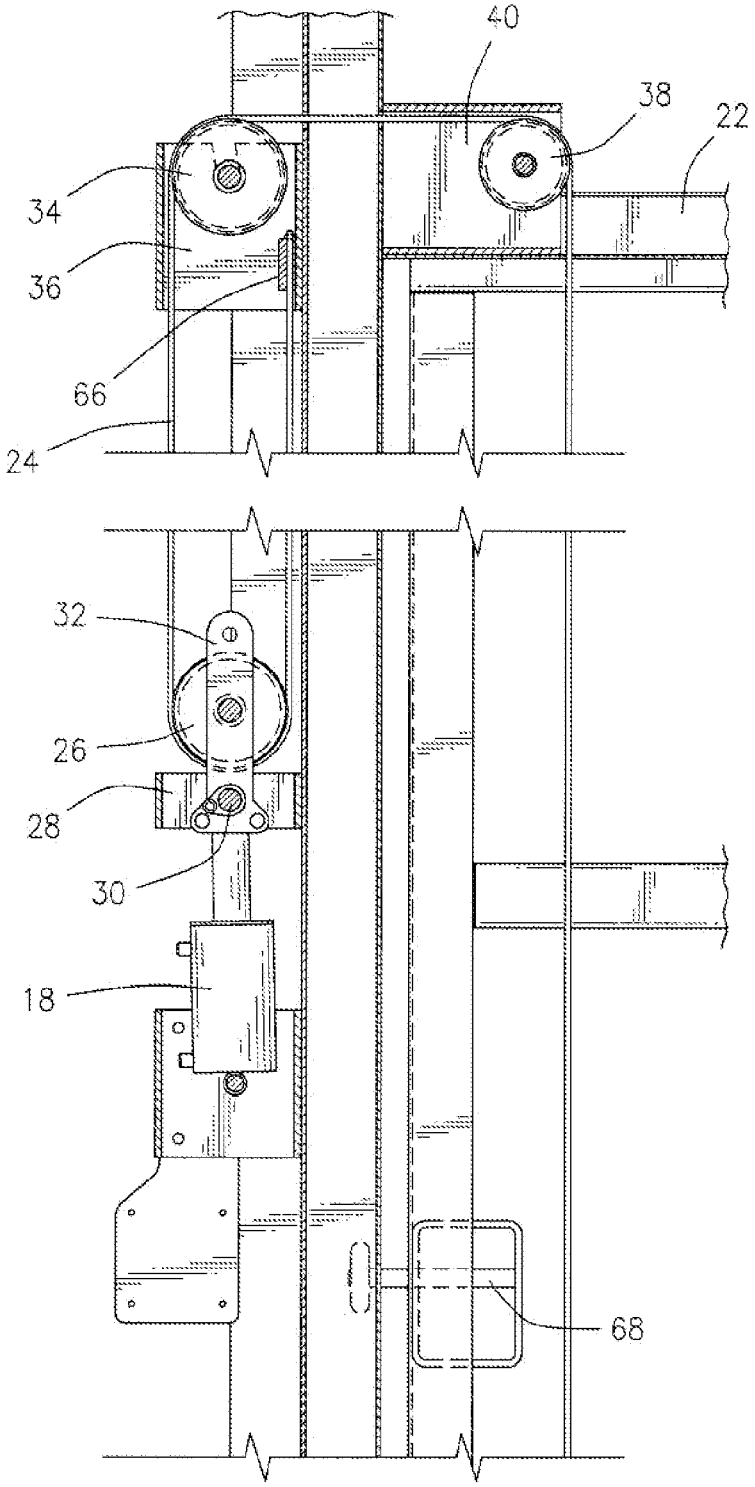
FIG. 5 is the sectional view taken along section line 5-5 of FIG. 2.

Shown in FIG. 5, a fixed pulley 26 is attached to a lift mechanism 18 by opposing arms 32, brace 28, and pin 30.

Each of a series or plurality of cables 24 beginning at terminal end 58 passes around the fixed pulley 26 and extends upwards toward a master pulley block 36. The plurality of cables 24 passes over master sheave 34, contained within a master pulley block 36, and extends longitudinally along an elongated support member 22. A plurality of single-grooved guide sheaves 38, 44, 50 are attached to an elongated support member 22 and are spaced at a designated distance from the master pulley block 36. The spacing of the guide sheaves 38, 44, 50 correspond with the location the individual cables are attached to the overhead door. Each of the single-grooved guide sheaves are associated with the master pulley block 36 and rotate in the same manner.

Figure 10:
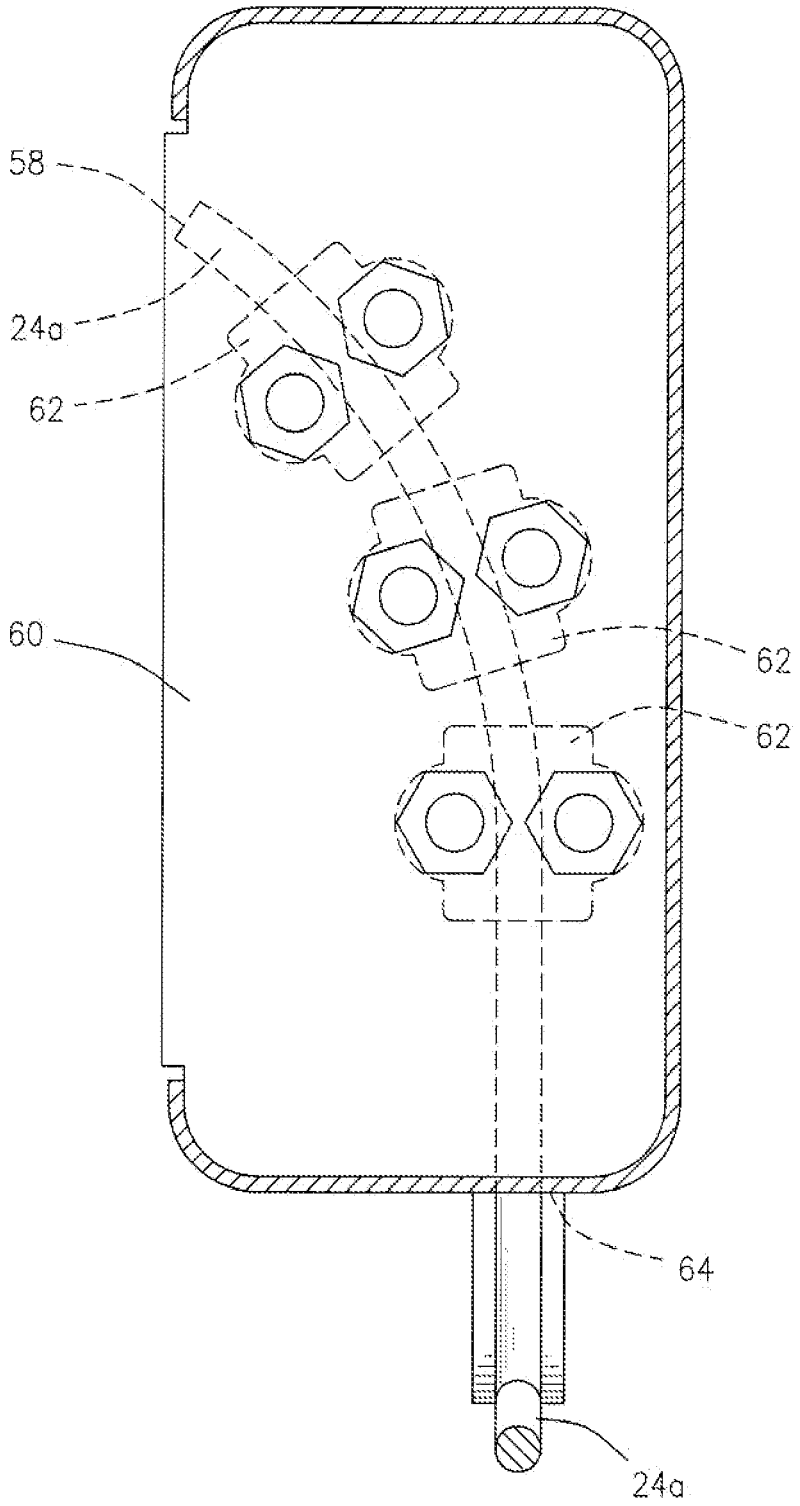
FIG. 10 is a sectional view taken along section line 10-10 of FIG. 9.
Figure 11:
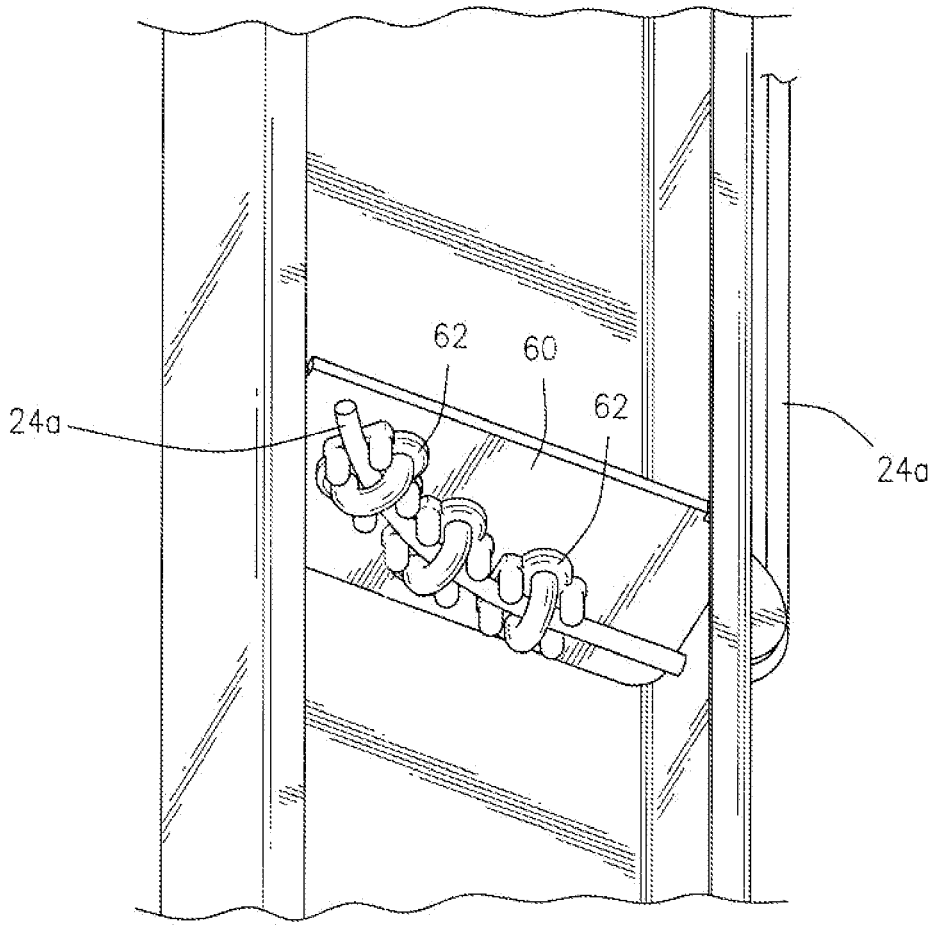
FIG. 11 is a bottom view of a clamp plate of the apparatus illustrated in FIG. 1.

A first single-grooved guide sheave 38 housed in block 40 is shown in FIG. 5. Each individual cable within the plurality of cables 24 is associated with an individual single-grooved guide sheave. Once the cable passes over its associated guide sheave, it extends tangentially from the guide sheave and downward for attachment to the overhead door. For example, as shown in the Figure, one of the cables in the plurality of cables 24 passes over guide sheave 38 and then extends tangentially from the guide sheave, terminating at an attachment point further described herein and shown in FIGS. 9, 10 and 11. The remaining cables of the plurality of cables 24 extend onward longitudinally along elongated support member 22, where another single cable passes over the next guide sheave and terminates downward for attachment to the overhead door, and so on until all the cables in the plurality of cables pass over a guide sheave and terminate downward for attachment to the overhead door in a similar manner.

Figure 6:
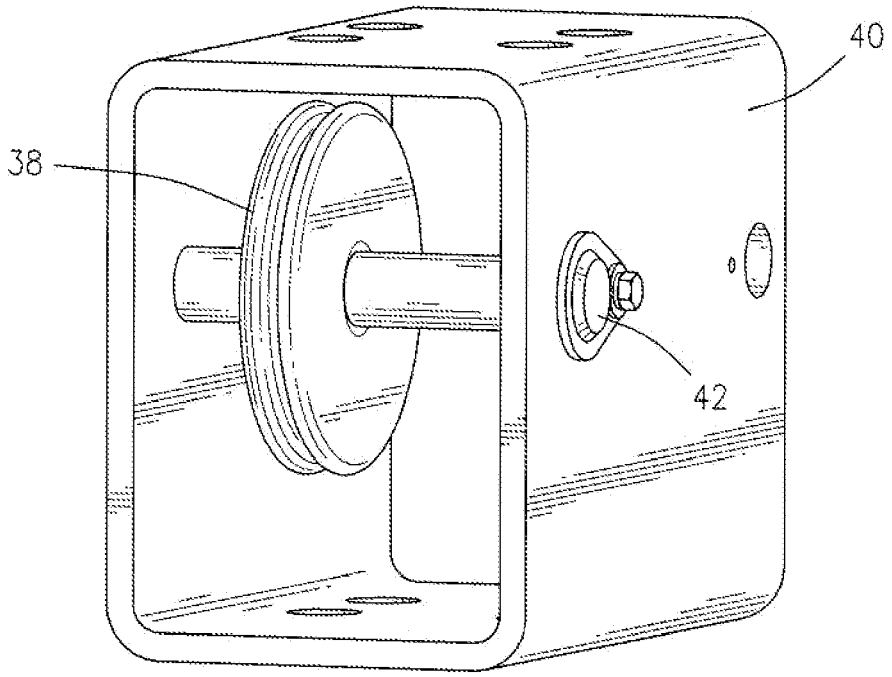
FIG. 6 illustrates a single-grooved guide sheave of the raising and lowering apparatus illustrated in FIG. 1.
Figure 7:
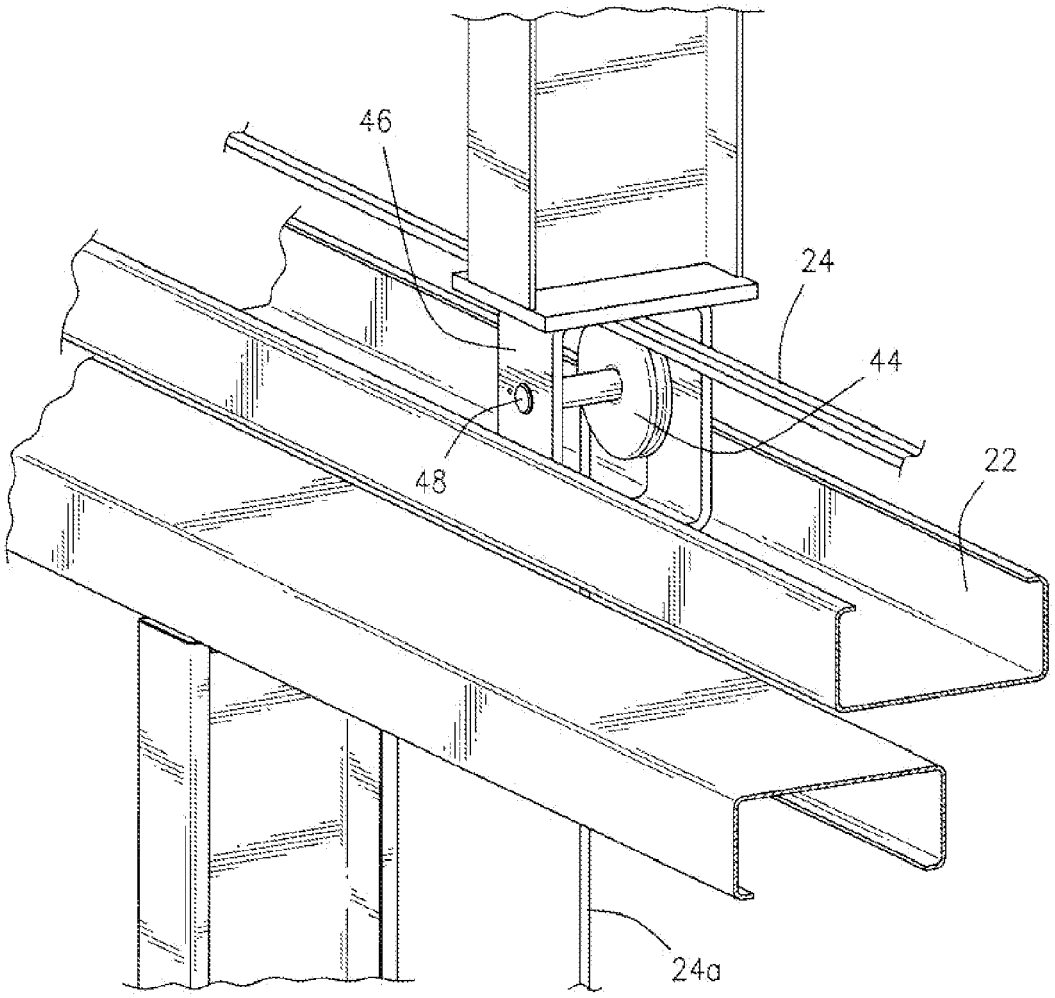
FIG. 7 illustrates a single-grooved guide sheave of the raising and lowering apparatus installed in elongated support member as illustrated in FIG. 1.

An individual single-grooved guide sheave 38 is shown in FIG. 6. The single-grooved sheave 38 defines a single-grooved cylindrical surface for receiving a single cable and is rotatably mounted on axle 42 which is connected to housing 40. Guide sheave 38 has one single groove arranged to receive an individual cable from the plurality of cables 24. Shown in FIG. 7, the plurality of cables 24 extends longitudinally along elongated support member 22. Guide sheave 44 receives an individual cable 24*a* of the plurality of cables and it passes over guide sheave 44 and extends tangentially from the guide sheave 44 and downward for attachment to an overhead door.

Figure 8:
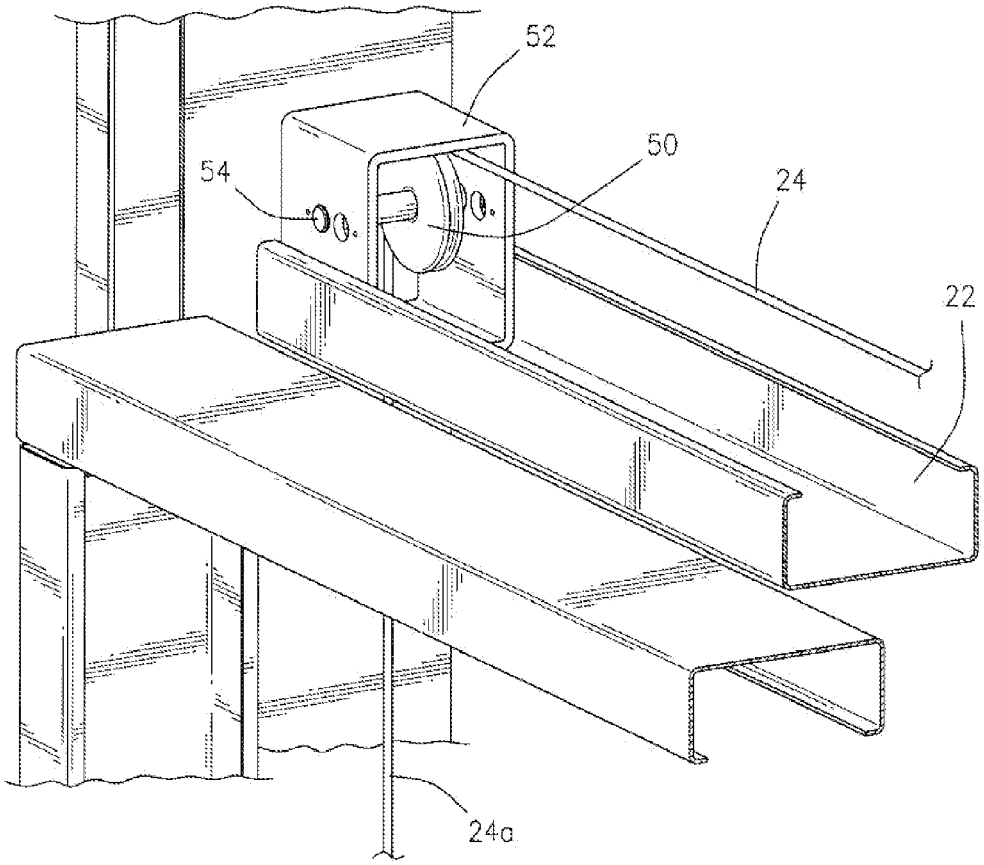
FIG. 8 illustrates a single-grooved guide sheave of the raising and lowering apparatus installed in an elongated support member as illustrated in FIG. 1.
Figure 9:
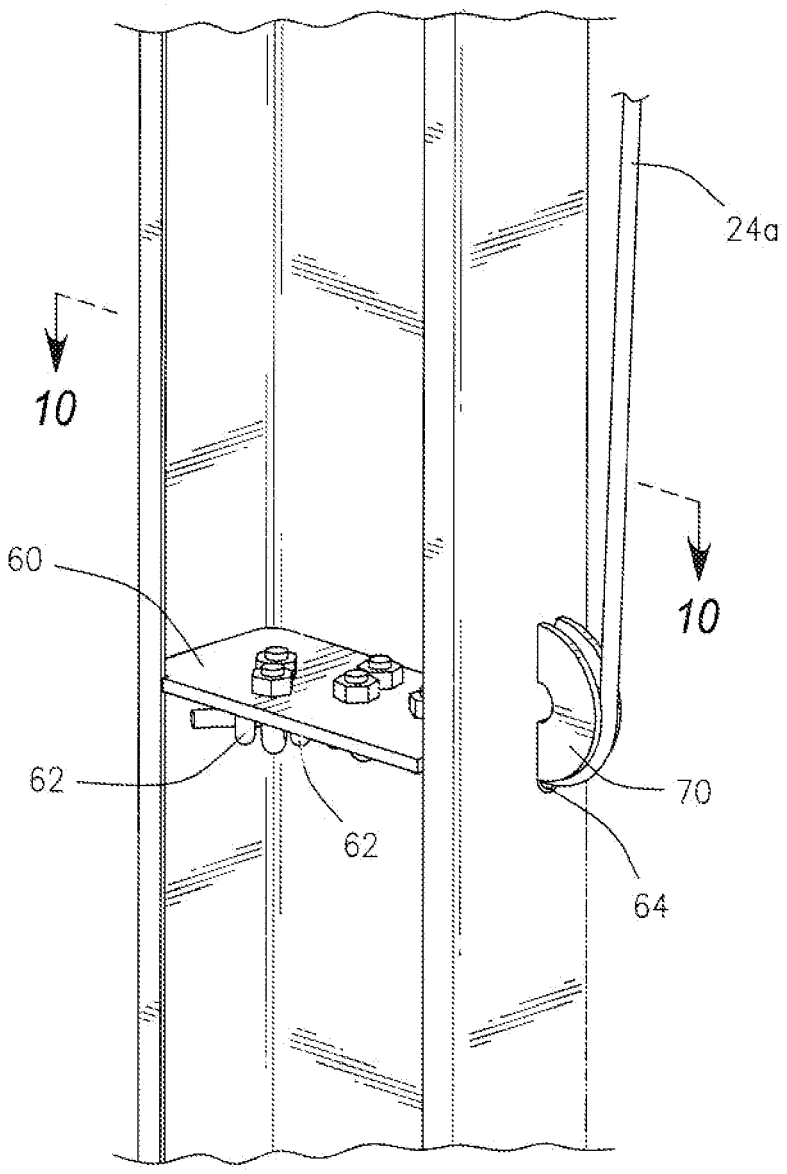
FIG. 9 illustrates a clamp plate welded into a metal C-channel of the overhead door with clamps for clamping the cable of the raising and lowering apparatus illustrated in FIG. 1.

FIG. 8 shows a guide sheave 50 rotating along axle 54 within housing 52. FIG. 8 shows the last cable and guide sheave association, wherein guide sheave 50 receives the last remaining cable of the plurality of cables 24. The cable 24*a* passes over guide sheave 50 and extends tangentially downward for attachment to the overhead door as shown in FIG. 9.

At each single-grooved guide sheave, a cable 24*a* extends tangentially downward and is received by a stationary sheave plate 70 which is fabricated onto a vertical C-channel member of the overhead door. The cable 24*a* enters the C-channel member through opening 64. As better shown in FIGS. 10 and 11, the cable 24*a* is securely fastened to clamp plate 60 by cable clamps 62.

The fastening component includes a clamp plate 60 with a plurality of pairs of drilled holes. The clamp plate 60 is welded into a vertical C-channel member of the overhead door. The cable clamps 62 comprise a threaded bolt, curved with two arms, and brace which are aligned within the plurality of drilled holes. The threaded bolt and brace are inserted through the clamp plate and into threaded nuts, where they are threadably received. The cable is run through the cable clamps 62, as can readily be seen in FIGS. 10 and 11, and securely tightened.

Whereas, the present invention has been described in relation to the drawings attached hereto, it should be understood that other and further modifications, apart from those shown or suggested herein, may be made within the spirit and scope of this invention.

What is claimed is:

1. An apparatus to raise and lower an overhead door comprising:

A single lift mechanism to provide all force needed to fully raise said overhead door from a lowered position, wherein said lift mechanism is positioned to a side of said overhead door;

A single master pulley block;

a pulley mounted to said lift mechanism, and in association with said master pulley block;

a plurality of guide sheaves, each of said plurality of guide sheaves associated with said master pulley block and supported by an elongated support member, each of said guide sheaves being spaced from said master pulley block; and a plurality of cables, each of said cables having a first and a second opposed end and passing from said first end at a first attachment point around said pulley attached to said lift mechanism and passing to and around said master pulley block, after which each cable passes over a separate associated one of said plurality of guide sheaves, thereby distributing each of said plurality of cables along the length of said support member, wherein each cable of said plurality of cables attaches at said second end by attachment means to an overhead door at multiple points along the door in order to distribute the lifting force evenly along the door.

2. The apparatus to raise and lower an overhead door as set forth in claim 1 wherein said master pulley block includes a master sheave being rotatably mounted on a central axle which rotates in a housing.

3. The apparatus to raise and lower an overhead door as set forth in claim 2 wherein said master sheave includes a plurality of grooves for receiving said cables passing around the master sheave.

4. The apparatus to raise and lower an overhead door as set forth in claim 1 wherein said fixed pulley is mounted on a central axle.

5. The apparatus to raise and lower an overhead door as set forth in claim 4 wherein said fixed pulley includes a plurality of grooves for receiving cables passing around said fixed pulley.

6. The apparatus to raise and lower an overhead door as set forth in claim 4 wherein said fixed pulley moves along with the lift mechanism.

7. The apparatus to raise and lower an overhead door as set forth in claim 1 wherein said plurality of guide sheaves defines a single-grooved cylindrical surface for receiving a single cable and is rotatably mounted on a central axle.

8. The apparatus to raise and lower an overhead door as set forth in claim 1 wherein said plurality of cables individually extends downward and attaches to the overhead door.

9. The apparatus to raise and lower an overhead door as set forth in claim 8 wherein said plurality of cables attaches to the overhead door by way of cable clamps.

10. The apparatus to raise and lower an overhead door as set forth in claim 1 wherein said elongated support member is mounted within a building structure.

11. The apparatus to raise and lower an overhead door as set forth in claim 1 wherein said lift mechanism is a hydraulic cylinder.

12. The apparatus to raise and lower an overhead door as set forth in claim 1 wherein said plurality of cables comprises six cables.

13. The apparatus to raise and lower an overhead door as set forth in claim 1 wherein said overhead is a one-piece door.

14. A method of raising an overhead door, which method comprises:

retracting a single lift mechanism to which a pulley is attached, said lift mechanism providing all force necessary to fully raise said overhead door from a lower position, and said lift mechanism and pulley positioned to a side of said overhead door, wherein a plurality of cables passes around said pulley and upward to pass over a single master pulley block;

pulling a plurality of cables downward toward the ground;

rotating said master pulley block, wherein said master pulley block receives the plurality of cables;

extending said plurality of cables longitudinally along an elongated support member;

receiving at least one cable of said plurality of cables onto at least one of said plurality of guide sheaves;

extending said at least one of said plurality of cables tangentially downward from said at least one of said plurality of guide sheaves;

raising said overhead door, wherein said overhead door is attached to said at least one of said plurality of cables in spaced attachment sites to distribute the lifting force of the cable across the door.

15. The method of raising an overhead door of claim 14 wherein each of said plurality of cables attaches to said overhead door at various points along the length of the door to distribute the lifting force evenly along the length of said door.

16. The method of raising an overhead door of claim 14 wherein said overhead door is a one-piece door.

17. A method of lowering an overhead door, which method comprises:

extending a single lift mechanism to which a pulley is attached, said lift mechanism providing all force necessary to fully raise said overhead door from a lower position, and said lift mechanism and pulley positioned to a side of said overhead door, wherein a plurality of cables passes around said pulley and upward to pass over a single master pulley block;

releasing slack to a plurality of cables;

rotating said master pulley block, wherein said master pulley block receives the plurality of cables;

extending said plurality of cables longitudinally along an elongated support member;

receiving at least one cable of said plurality of cables onto at least one of said plurality of guide sheaves;

extending said at least one of said plurality of cables tangentially downward from said at least one of said plurality of guide sheaves;

lowering said overhead door, wherein said overhead door is attached to said at least one of said plurality of cables in spaced attachment sites to distribute the lifting force of the cable across the door.

18. The method of lowering an overhead door of claim 17 wherein each of said plurality of cables attaches to said overhead door at various points along the length of the door to distribute the lifting force evenly along the length of said door.

19. The method of lowering an overhead door of claim 17 wherein said overhead door is a one-piece door.

* * * * *